US010116088B2

(12) United States Patent
Pham et al.

(10) Patent No.: US 10,116,088 B2
(45) Date of Patent: Oct. 30, 2018

(54) PLUG CONNECTOR CASING AND PLUG CONNECTOR

(71) Applicant: Lisa Draexlmaier GmbH, Vilsbiburg (DE)

(72) Inventors: Thi-Thanh-Truc Pham, Vilsbiburg (DE); Stefan Wimmer, Hohenthann (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/591,090

(22) Filed: May 9, 2017

(65) Prior Publication Data

US 2017/0331222 A1 Nov. 16, 2017

(30) Foreign Application Priority Data

May 10, 2016 (DE) ..... 10 2016 108 621.5

(51) Int. Cl.
*H01R 13/58* (2006.01)
*H01R 13/506* (2006.01)

(52) U.S. Cl.
CPC ..... *H01R 13/5812* (2013.01); *H01R 13/506* (2013.01); *H01R 2201/26* (2013.01)

(58) Field of Classification Search
CPC ..... H01R 13/567; H01R 13/5812
USPC ..... 439/470, 472, 473
See application file for complete search history.

(56) References Cited

U.S. PATENT DOCUMENTS 3,493,205 A * 2/1970 Bromberg ..... F16L 5/00 16/2.5
3,617,612 A * 11/1971 Patton ..... H02G 3/16 174/59
4,195,899 A * 4/1980 Radloff ..... H01R 13/5812 439/468
4,516,822 A * 5/1985 Wolfel ..... H01R 13/5812 439/425

(Continued)

FOREIGN PATENT DOCUMENTS

DE 100 45 714 A1 5/2001
DE 10 2013 205 447 A1 10/2014
WO WO 2009/027984 A2 3/2009

OTHER PUBLICATIONS

Office Action in German Application No. DE 10 2016 108 621.5, dated Feb. 16, 2017.

(Continued)

*Primary Examiner* — Neil Abrams
(74) *Attorney, Agent, or Firm* — Finnegan, Henderson, Farabow, Garrett & Dunner LLP

(57) ABSTRACT

The present disclosure relates to a plug connector casing adapted for use as a vehicle plug connector. In one implementation, the plug connector casing may include a main body made of plastic and a casing lock that is displaceable relative to the main body along a plugging direction. In some implementations, the plug connector casing may be equipped with a cable bracket that is capable of being releasably latched to a cable support that is integral with the main body, extends from an end face of the main body past the casing lock, and has one or more latch elements adjacent thereto. The present disclosure also relates to a plug connector provided with a plug connector casing of this type.

15 Claims, 3 Drawing Sheets

(56) References Cited

U.S. PATENT DOCUMENTS 5,259,785 A * 11/1993 Inaba ..... H01R 13/58 439/364
5,785,547 A * 7/1998 Cross ..... H01R 13/6392 439/369
5,853,298 A * 12/1998 Pacher ..... H01L 29/1608 439/352
5,895,292 A * 4/1999 Affeltranger ..... H01R 13/518 439/607.56
6,540,547 B2 * 4/2003 Zweigle ..... H01R 13/5804 439/464
6,663,415 B1 * 12/2003 Wu ..... H01R 13/5808 439/460
6,755,675 B2 * 6/2004 Szabo ..... F16L 25/01 439/191
6,824,420 B2 * 11/2004 Ushiro ..... H01R 13/5816 439/455
7,021,959 B2 * 4/2006 Tsuji ..... H01R 13/562 439/470
7,041,904 B2 * 5/2006 Da Silva ..... H01R 13/5804 174/135
7,114,987 B2 * 10/2006 Nad ..... H01R 13/5808 439/470
7,182,626 B2 * 2/2007 Langolf ..... H01R 13/506 439/473
7,241,183 B2 * 7/2007 Wasalaski ..... H01R 13/447 439/686
7,484,993 B2 * 2/2009 Amidon ..... H01R 13/5825 439/418
7,537,479 B2 * 5/2009 Miyamoto ..... H01R 13/506 439/468
7,927,129 B2 * 4/2011 Gimbel ..... H01R 13/5829 439/467
7,950,951 B2 * 5/2011 Mossner ..... H01R 4/2433 439/470
7,976,329 B2 * 7/2011 Foung ..... H01R 13/633 439/344
9,231,337 B2 * 1/2016 Sakakura ..... H01R 13/5804
9,300,084 B2 * 3/2016 Wimmer ..... H01R 13/639
9,337,572 B2 * 5/2016 Maranto ..... H01R 13/5845
2014/0295685 A1 10/2014 Wimmer

OTHER PUBLICATIONS

Decision to Grant in German Application No. DE 10 2016 108 621.5, dated Oct. 11, 2017.
German Office Action dated Feb. 16, 2017, 10 pages.

* cited by examiner

PLUG CONNECTOR CASING AND PLUG CONNECTOR

This application claims the benefit of priority of German Patent Application No. 102016108621.5, filed on May 10, 2016, which is incorporated herein by reference.

TECHNICAL FIELD

The disclosed embodiments relate to a plug connector casing that is adapted for use in a vehicle. The disclosed embodiments also relate to a plug connector provided with a casing of this type.

BACKGROUND

A plug connector with a casing is known from DE 10 2013 205 447 A1. The plug connector casing comprises a main body made of plastic, with an interior contact chamber to accommodate an electrical plug contact element. The plug connector casing also includes a casing lock that is guided for movement relative to the main body along a plugging direction of the plug connector. The casing lock may be provided in the form of a securing mechanism, for example. The casing lock itself, which forms a so-called CPA (Connection Position Assurance) or is a part thereof, is intended to ensure that the plug connector casing and a socket (casing) are correctly interlocked. The CPA can confirm that the plug connection is correctly locked and prevent the plug connection or lock from being unintentionally disconnected. Even though this may ensure that the plug connection functions reliably, a way is still needed to dependably hold to the plug connector casing an electric cable leading into the plug contact element.

One possibility that has proven itself in practice is to secure the cable with a cable tie that surrounds the cable and attaches it to the plug connector casing. However, affixing a cable tie to the plug connector casing is difficult and strenuous, resulting in long installation cycle times. Furthermore, structural aspects result in a certain degree of fluctuation in the mounted strength of the cable tie. The only way to remove the cable tie is to destroy it.

Another way to secure cables is proposed in EP 2 458 690 B1, for example. This publication describes how an electric cable is held on a plug connector casing by a multi-part cable bracket, but the casing does not have a displaceable casing lock. One disadvantage of this solution is that the multi-part structure of the cable bracket impedes the production and installation of the plug connector and/or its casing.

DESCRIPTION

Embodiments of the present disclosure may create an easily mountable means for securing a cable to a plug connector casing using simple constructional means.

The disclosed embodiments may include the device of claim 1. Other embodiments are described in the dependent claims, the description and the accompanying drawings.

A plug connector casing according to the disclosed embodiments for a plug connector in a vehicle may comprise a main body made of plastic and may be produced by injection molding. The main body may include an interior contact chamber for accommodation of an electrical plug contact element. A plug contact element suitable for this purpose is known, for example, in the post-published German patent application 102016201103.0. An electric cable may lead to the plug contact element accommodated in the contact chamber, for example, via a through-hole in an end face of the plug connector casing. A casing lock may be guided for movement relative to the main body along a direction of plugging of the plug connector or plug connector casing; this casing lock may form a so-called CPA (complete or partial).

According to the disclosed embodiments, the plug connector casing may have a cable bracket that is separate from the main body and can be releasably latched to a cable support integrally formed with the main body. The cable support extends from an end face of the main body past the casing lock and has one or more latch elements adjacent to it. The cable to be secured, which may be guided through the end face, also may extend past the casing lock, rest on the cable support and be secured to it by the cable bracket.

In some embodiments, then, the cable support is capable of performing multiple functions, for example, guiding the casing lock, guiding the cable and latching the cable bracket, thereby reducing tension on the plug connector. Contrary to a cable tie, the cable bracket may be releasably latched, thereby allowing it to be removed without being destroyed. In addition, a steady installation force may be facilitated, since the latch element and the cable bracket are oriented in a defined relationship to one another.

In some embodiments, the casing lock may be actuated with particular ease if the cable support has a guide section arranged between the end face and the latch element to guide the casing lock. For example, the casing lock along which the cable is guided can be supported on the cable support, with the casing lock sliding thereupon.

In some embodiments, to facilitate installation of the cable bracket, the cable support may have a guide slot to guide the cable bracket in a latching direction perpendicular to the plugging direction or to the direction of movement of the casing lock. For example, the guide slot may have two guide walls that are perpendicular to the direction of plugging, between which the cable bracket is guided.

The installation may be further facilitated if the guide slot is beveled such that it tapers toward the latch element. In such embodiments, in an insertion region of the guide slot, the slot is wider or broader than in the latching area. This conical or tapering design may allow for easy positioning and insertion into the guide slot.

In some embodiments, to avoid the intrusion of foreign bodies, such as cables with small cross-sections, between the main body and the cable bracket or between the cable guide and the cable bracket, two contact bevels spaced apart from one another may be formed in the guide slot following the latch element in the direction of latching, to complement the beveled cable bracket. In such embodiments, only a small space remains for the contact bevels between the cable bracket and the cable guide; the size of the small space depends on the variable width, namely the widthwise extension along the direction of plugging. For example, the space can be adapted to the blade width of a screwdriver for removing the cable bracket. The cable bracket may also be kept from rattling, since it lies closely against or hugs the cable guide.

In some embodiments, the cable may be secured if, in order to span the cable, the cable bracket is at least partly arcuate in shape with two laterally extending retaining arms. The arc radius may be adapted to the cross-section of the cable to be secured.

In some embodiments, in order to latch the cable bracket to the latch element, which may be embodied as a detent lug or hook, the retaining arms may each have at least one detent tab formed by a recess in the material and adapted to engage with the latch element. In some embodiments, the detent tab may be formed by a recess in the material within the retaining arms.

In some embodiments, at least one stopping mechanism projecting into the arc interior may be formed on each of the retaining arms to enable abutment with the cable support. The stop or stops may be arranged behind the detent tab or behind the latch element of the cable support in the latching direction of the cable bracket.

In some embodiments, the cable bracket may have a grip on its crest adapted to engage by exertion of pressure on the cable or to release through pulling away from the cable. For example, the grip may be T-shaped.

In some embodiments, the cable bracket can have abutting ribs on an arc surface facing the cable, to be at least partly pressed into the cable insulation.

The disclosed embodiments also relate to an electrical plug connector with a plug connector casing in one or more of the variants described above. An electrical plug contact element may be accommodated in the plug connector casing and connected to an electric cable.

BRIEF DESCRIPTION OF THE DRAWINGS

In the drawings:

The drawings are merely schematic representations and serve merely to explain one or more embodiments. The same or similar elements are consistently provided with the same reference numbers.

FIG. 1 shows a perspective side view of an electrical plug connector 100 that adapted for use as a high-voltage plug connector in vehicles. The plug connector 100 is fitted for being mated with a socket casing or socket (not shown here) that is equipped with a plug-in contact to form a plug connection in a plugging direction S. The plugging direction S is congruent with a longitudinal axis (not specifically designated) of the plug connector 100.

The plug connector 100 comprises a plug connector casing 1 that is subdivided into a roughly cuboid main body 2; a casing lock 3 guided for movement thereupon, forming a CPA (Connection Position Assurance); a secondary lock 4; and a cable bracket 5. FIG. 1 further depicts that an electric line 6 in the form of an insulated cable extends away from the plug connector casing 1 along the plugging direction S.

Figure 1:
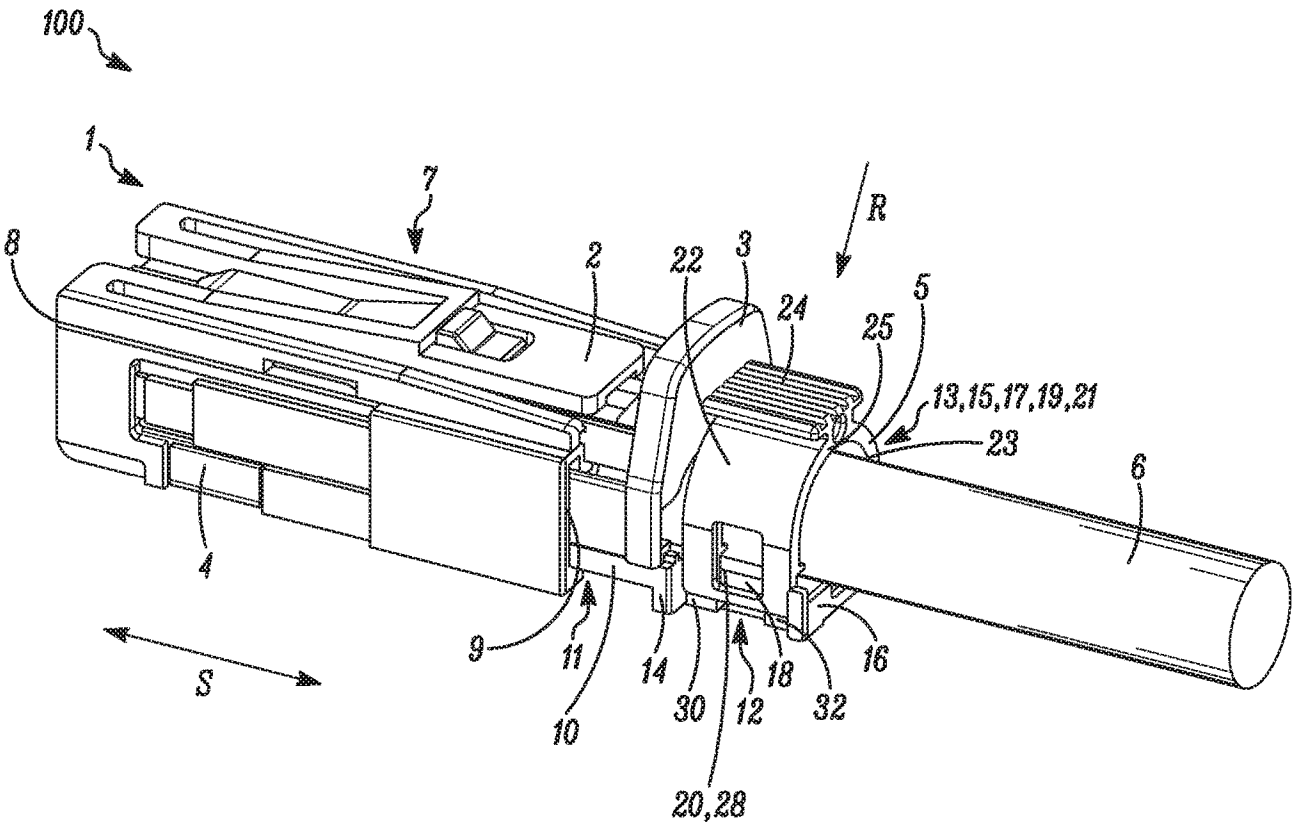
FIG. 1 shows a perspective side view of a plug connector having a plug connector casing according to an example embodiment of the present disclosure.

The main body 2 comprises an inside contact chamber 7 that accommodates an electrical plug contact element when in the installed or potentially plugged-in state, as described in detail in the post-published German patent application number 102016201103.0. The plug contact element, for example, is primarily locked via detent tabs formed thereupon in the contact chamber 7. The plug contact element may be additionally locked via a secondary lock 4 in or on the plug connector casing 1. The main body 2 also has a partly open first end face 8 through which the plug-in contact can be inserted into the plug contact element, and a second end face 8 opposite the first, via which the cable 6 can be guided to the plug contact element.

To lock the plug connector casing 1 to the socket or socket casing, the casing lock 3 is provided at the second end face 9; the casing lock may permit plugging together and locking only if the plug-in contact (not shown) is situated in the plug contact element. The locking is then accomplished by moving the casing lock 3 toward the second end face 9 of the main body 2. Thus, the casing lock 3 depicted in FIG. 1 is not yet in the locked state. The casing lock 3 extends along the plugging direction S, is guided inside the main body 2, and has a collar adjacent to the second end face 9. The collar actuates the casing lock 3 and has a stopping mechanism (not shown) to enable abutment with the second end face 9.

FIG. 1 also shows that a cable support 10 integrally formed with the main body 2 made of plastic extends away from the main body 2 in a plugging direction S. The cable support 10 thus extends beyond the second end face 9. In addition, the cable support 10 also extends past the casing lock 3 and/or its collar. The casing lock is guided on a segment of the cable support 10 adjacent to the second end face 9 along a guide segment 11. The cable lies on the cable support 10 in such a way that it is carried with the cable support. Thus, the cable 6 is guided through between the cable support 10 and the casing lock 3. To the side of this, a first guide slot 12 and a second guide slot 13 (hidden here by the plug connector casing 1) are formed on the cable support 10 in the plugging direction S. This places the guide section 11 between the second end face 9 and the guide slots 12, 13. The guide slots 12, 13 are formed by a first guide wall 14, 15 and a second guide wall 16, 17, oriented perpendicularly to the plugging direction S. The guide walls 14, 15 and 16, 17 are shaped in such a way that the guide slots 12, 13 taper in a latching direction R. Furthermore, the guide slots 12, 13 each have a latch element 18, 19 in the form of a detent lug.

As shown in FIG. 1, when in the installed state shown therein, the cable support 10 is guided in the mutually opposite guide slots 12, 13 in the latching direction R, which is perpendicular to the plugging direction S; the cable support is also releasably latched to the corresponding latch element 18, 19 via one detent tab 20, 21 each formed on the cable bracket 5. The detent tabs 20, 21 in FIG. 1, however, are not (yet) completely locked to the latch elements 18, 19.

Figure 2:
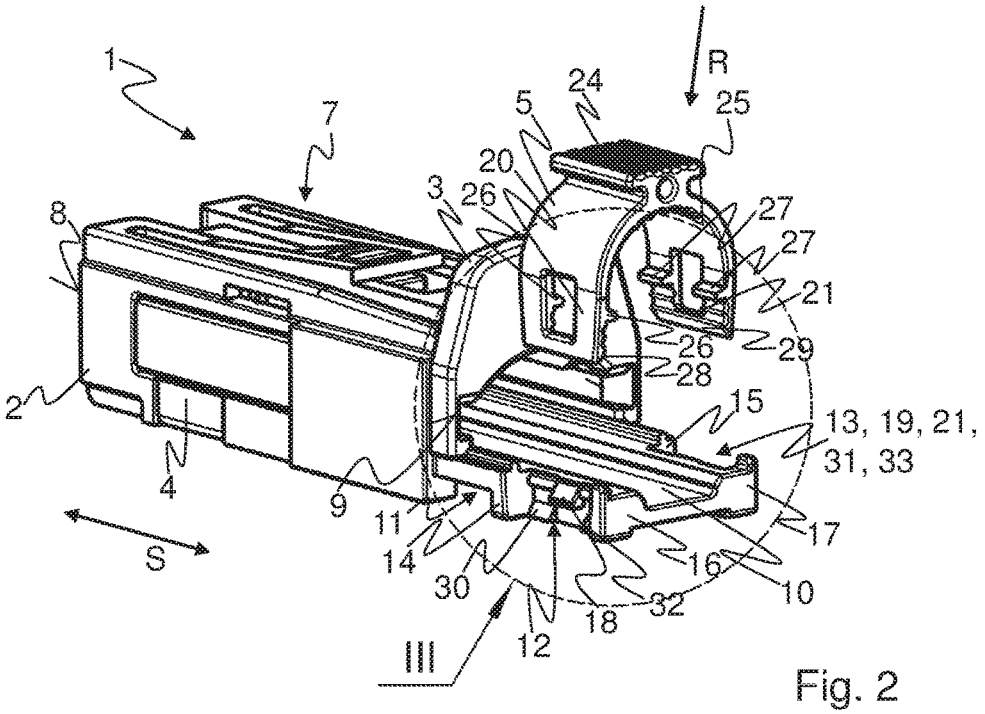
FIG. 2 shows a perspective side view of a plug connector casing according to an example embodiment of the present disclosure, with a still unattached cable bracket.

FIG. 2 shows the plug connector casing 1 in a perspective side view without the cable 6; the cable bracket 5 is not yet engaged either. As depicted in FIG. 2, the cable bracket 5 is essentially arcuate and has two retaining arms 22, 23. The detent tabs 20, 21 are formed on the retaining arms 22, 23 by one recess or through hole each in the material. In this region the retaining arms 22, 23 are also beveled in such a way that they taper in the latching direction R. The tapering is complementary to the aforementioned tapering of the guide slots 12 13. A T-shaped grip element 24 is arranged on a crest of the arc formed by the retaining arms 22, 23; for instance, it is provided with grooves to form an intuitively recognizable pressure area for being pressed into engagement.

Furthermore, a plurality of abutting ribs 25 are provided on an inner area of the arc, particularly in and around the crest; the abutting ribs are designed to be at least partially pressed into the insulation of a cable 6. Adjacent to the detent tabs 20, 21, a stopping mechanism 26, 27 projecting into the arc's interior is provided on every retaining arm 22, 23, to enable abutment with the cable support 10. The stops 26, 27 prevent the cable bracket 5 from being pressed too far in the latching direction R, i.e. beyond engagement with the latch elements 18, 19. In addition, opposite contact bevels 28, 29 for abutment with the cable support 10 are provided on the retaining arms 22, 23, behind the detent tabs 20, 21 (below them in FIG. 2) in the latching direction R.

As further depicted in FIG. 2, the latch element 18, 19 is centrically arranged in the respective guide slot 12, 13 along the plugging direction S. Two contact bevels 30, 31 and 32, 33 are arranged adjacent thereto—that is, before and behind in the plugging direction S. The contact bevels 30 to 33 are designed to abut the corresponding complementary opposite contact bevels 28, 29 of the cable bracket 5. In this way, the intrusion of foreign bodies such as small cross-sectional cables between the cable bracket 5 and the cable support 10 can be prevented, since they lie in close juxtaposition. However, a space remains between the contact bevels 30 and 32 and/or 31 and 33 in the plugging direction S. The space may be adapted to a blade width of a screwdriver to be used to release the latch between the particular latch element 18, 19 and the particular detent tab 20, 21.

Figure 3:
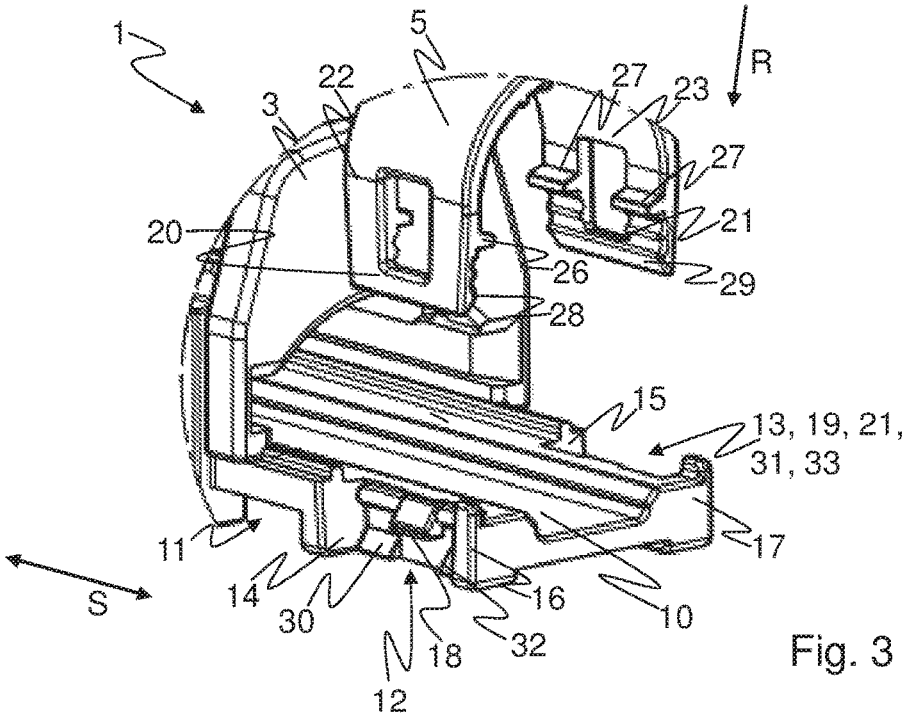
FIG. 3 shows a perspective detail of a section of the plug connector casing from FIG. 2.

FIG. 3 shows a detail of the drawing from FIG. 2, in which the arrangement and design of the opposite contact bevels 28, 29 of the cable bracket 5 and of the contact bevels 30 to 33 of the cable support 10 are more clearly recognizable. The central arrangement of the latch elements 18, 19 is also shown.

Figure 4:
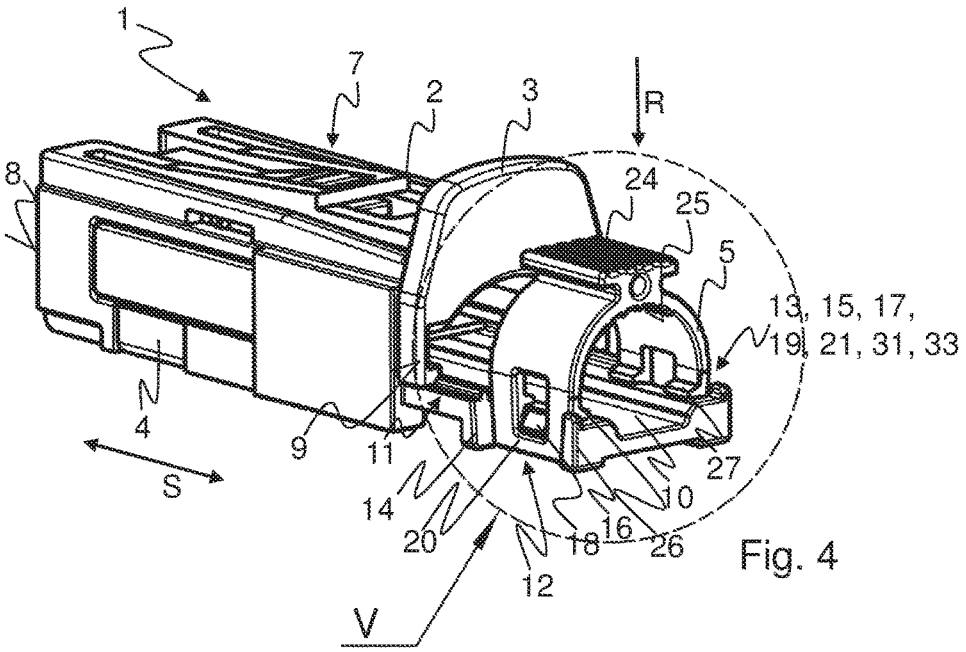
FIG. 4 shows a perspective side view of a plug connector casing according to an example embodiment of the present disclosure, with a latched-on cable bracket.

As depicted in FIG. 4, which shows a perspective side view of the plug connector casing 1, the cable bracket 5 engages with the latch elements 18, 19 of the cable bracket 10 via its detent tabs 20, 21. Furthermore, as an example, the casing lock 3 is shown in the locked state.

Figure 5:
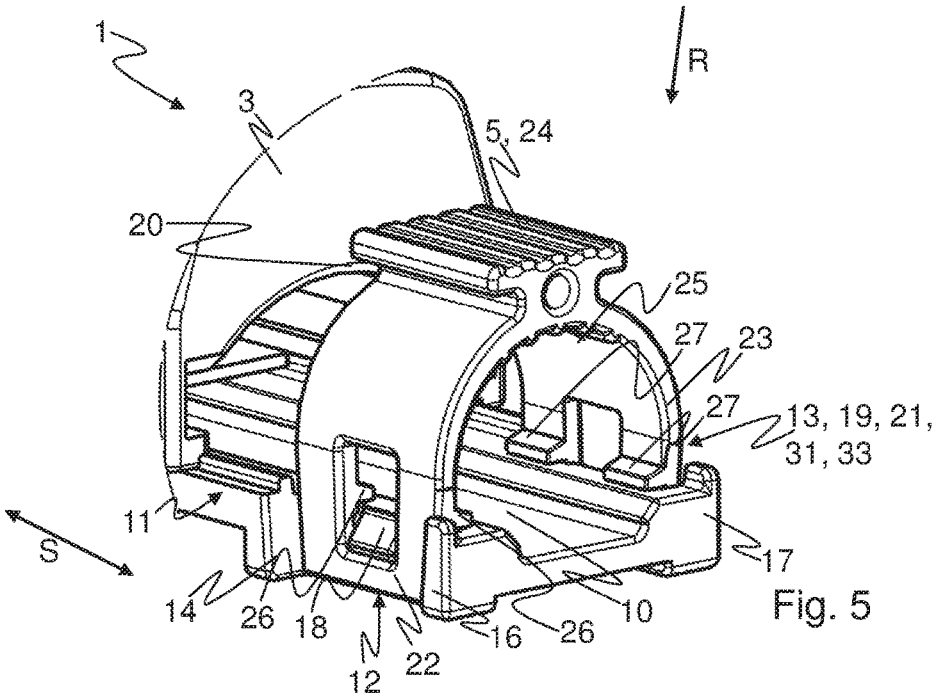
FIG. 5 shows a perspective detail of a section of the plug connector casing from FIG. 4.

FIG. 5 shows a detail of the drawing from FIG. 3, in which it is depicted that the stops 26, 27 abut the cable support 10. This may permit simple installation of the cable bracket 5.

LIST OF REFERENCE NUMBERS

1 plug connector casing
2 main body
3 casing lock
4 secondary lock
5 cable bracket
6 electric line (e.g., insulated cable)
7 contact chamber
8 first end face
9 second end face
10 cable support
11 guide section
12 first guide slot
13 second guide slot
14, 15 first guide wall(s)
16, 17 second guide wall(s)
18, 19 latch element (s) (e.g., detent lug)
20, 21 detent tab(s)
22, 23 retaining arm(s)
24 grip element
25 plurality of abutting ribs
26, 27 stop(s)
28, 29 opposite contact bevel(s)
30-33 contact bevel(s)
R latching direction
S plugging direction

What is claimed is:

1. A plug connector casing for a vehicle plug connector used to connect a cable, comprising:

a main body of plastic material;

a casing lock that is displaceable relative to the main body along a plugging direction;

a cable support that is integrated with the main body and that is extending from an end face of the main body past the casing lock, wherein the cable support further includes one or more latch elements and has a guide slot adapted to guide a cable bracket in a latching direction perpendicular to the plugging direction, the guide slot having two mutually spaced apart contact bevels molded thereon behind the latch element with respect to the latching direction; and the cable bracket retained on an end portion of the cable and adapted to be releasably latched to the cable support by the one or more latch elements.

2. The plug connector casing according to claim 1, wherein the cable support has a guide section arranged between the end face and the latch element adapted to guide the casing lock along the plugging direction.

3. The plug connector casing according to claim 1, wherein the guide slot is beveled to taper toward the latch element.

4. The plug connector according to claim 1, wherein the cable bracket is arcuate and has two laterally extending retaining arms.

5. The plug connector casing according to claim 4, wherein the retaining arms each have at least one detent tab formed by a recess in the retaining arms and adapted for engagement with the latch element.

6. The plug connector casing according to claim 4, wherein each retaining arm has at least one stopping mechanism projecting into an interior of an arc formed by the retaining arms and adapted to enable abutment with the cable support.

7. The plug connector casing according to claim 1, wherein the cable bracket has a grip element on a crest thereof adapted for latching by pressing or for releasing by pulling.

8. The plug connector casing according to claim 1, wherein the cable bracket has abutting ribs on an arc surface facing the cable and adapted to be pressed at least partly into cable insulation.

9. A plug connector for connecting an electric cable, comprising:

an electric plug contact element connected to the electric cable; and a plug connector casing at least partially surrounding the electric plug contact element and including:

a main body, a cable support integrated with the main body, a casing lock displaceable relative to the main body along a plugging direction, and a cable bracket retained on an end portion of the cable and adapted for being releasably latched to the cable support, wherein the cable support extends from an end face of the main body past the casing lock and having one or more latch elements adjacent thereto, the cable support has a guide slot adapted to guide the cable bracket in a latching direction perpendicular to the plugging direction, and the guide slot has two mutually spaced apart contact bevels molded thereon behind the latch element with respect to the latching direction.

10. The plug connector of claim 9, wherein the guide slot is beveled to taper toward the latch element.

11. The plug connector of claim 9, wherein the cable bracket is arcuate and has two laterally extending retaining arms.

12. The plug connector of claim 11, wherein the retaining arms each have at least one detent tab formed by a recess in the retaining arms and adapted for engagement with the latch element.

13. The plug connector of claim 11, wherein each retaining arm has at least one stopping mechanism projecting into an interior of an arc formed by the retaining arms and adapted to enable abutment with the cable support.

14. The plug connector of claim 9, wherein the cable bracket has a grip element on a crest thereof adapted for latching by pressing or for releasing by pulling.

15. The plug connector of claim 9, wherein the cable bracket has abutting ribs on an arc surface facing the cable and adapted to be pressed at least partly into cable insulation.

* * * * *